United States Patent [19]

Cojean et al.

[11] 4,324,385

[45] Apr. 13, 1982

[54] DEVICE FOR REMOVING AND DEPOSITING LOADS BETWEEN TWO SUPPORTS IN REPEATED RELATIVE VERTICAL MOVEMENT

[75] Inventors: Maurice Cojean, Nantes; Jean-Paul Colin, Saint Sebastien, both of France

[73] Assignee: Ateliers et Chantiers de Bretagne ACB, France

[21] Appl. No.: 938,247

[22] Filed: Aug. 30, 1978

[30] Foreign Application Priority Data

Aug. 31, 1977 [FR] France ..... 77 26503

[51] Int. Cl.[3] ..... B66D 1/48

[52] U.S. Cl. ..... 254/270; 254/285; 254/900; 414/139

[58] Field of Search ..... 254/267-277, 254/281, 284, 285, 375-379, 900, 295, 288; 414/139, 138

[56] References Cited

U.S. PATENT DOCUMENTS

| | | | |
|---|---|---|---|
| 2,271,426 | 1/1942 | Harry | 254/295 X |
| 3,189,196 | 6/1965 | Carl et al. | 254/173 R X |
| 3,233,746 | 2/1966 | Fawall | 254/173 R X |
| 3,365,075 | 1/1968 | Van Gils et al. | 254/288 X |
| 3,512,65/ | 5/1970 | Chambers | 414/138 |
| 3,753,552 | 8/1973 | Barron | 254/173 R |
| 4,118,012 | 10/1978 | Kerr et al. | 254/173 R |
| 4,121,293 | 10/1978 | Kerr et al. | 254/173 R X |
| 4,121,806 | 10/1978 | Iato et al. | 254/172 |

*Primary Examiner*—John M. Jillions

*Attorney, Agent, or Firm*—Learman & McCulloch

[57] ABSTRACT

The invention relates to a device for removal and deposition of loads between two supports in repeated relative vertical movement. The device consists essentially of a crane close to the high point of the support on which said load rests in its rising movement for lifting the load. To do this, the lifting device suspended from the hook of the lifting crane comprises a structure supporting a winch, a detection device for the winding in or out of the cable wound by said winch and brakes adapted to block the paying out of said cable when its winding ceases momentarily, that is to say when the speed of lifting of the crane is equal to the decreasing speed of heaving of the support. The device is applicable to the unloading of ships supplying off-shore platforms.

12 Claims, 8 Drawing Figures

DEVICE FOR REMOVING AND DEPOSITING LOADS BETWEEN TWO SUPPORTS IN REPEATED RELATIVE VERTICAL MOVEMENT

BACKGROUND OF THE INVENTION

1. Field of the Invention

The present invention relates to a device for the removal and deposition of loads between two supports in repeated relative vertical motion.

The invention applies more particularly to the removal of loads resting on the deck of a ship in the course of trans-shipment operations at sea, and notably in the provisioning of marine platforms situated offshore.

2. Description of the Prior Art

The embarkment of packages and various loads for drilling and constructional operations at sea is always a difficult operation, especially in bad weather, when the relative movements of the ships generated by the swell are considerable, the relative vertical movements being called "heaving" in the following description.

At present, in heavy weather, in the handling of the removal of a load from a supply ship, it frequently happens that in hoisting under the effect of the swell, the deck of the ship strikes the load from below after it has already been raised from the deck and this in spite of high lifting speeds obtainable today with modern cranes and the high skill of crane operators who cannot always unfortunately avoid accidents sometimes very serious (loss of the packages or breaking of the crane jib), or even fatal accidents.

For the operation to be carried out without mishap, the load should be lifted from the deck of the ship when the latter reaches the vicinity of the crest of the heaving movement, which necessitates starting the lifting a certain time beforehand, on the one hand to take into account the inertia of the crane to be put into motion and, on the other hand, to take up the slack of the slings attached to the packages and tighten them. Now the crane operator generally experiences great difficulty in estimating and sensing the limited period of time during which he can start-up the lifting of the load, since:

the crane cannot, on account of its limited speed and its own inertia, constantly follow the movement due to the swell by keeping the slings taut, the crane operator cannot correctly evaluate, taking into account its position, the heaving of the ship which occurs vertically with respect to him, the sling of the package being slack at the beginning of the operation to permit attachment, it must be tightened before being able to lift the package, this tightening time being of the same order of magnitude as the period of the swell, and the crane operator cannot very well evaluate in advance the length of cable that he will have to wind in, so that he runs the risk of not terminating his sling tautening operation at the moment of the crest of the swell.

Progress has been made with the pulley-block described in French Pat. No. 1,509,895 and which includes a load cable tensioning device; the latter ensures compensation for the heaving and permanent tension in the slings before the raising of the load which is obtained by braking the unwinding of the cable. However, since the blocking of the brake is carried out manually at a moment judged favorable by the crane operator, the success of the operation depends entirely on the skill of the latter and if the braking order is given when the support for the load is lifted, the slings and the cable take up the slack and are suddenly tightened when the support drops, which is very dangerous and can result in accidents.

In addition, in the course of lifting, taking into account the irregular movements in the plane of the supply ship, and due to the fact that the crane operator cannot simultaneously take care of the tightening of the sling and the lifting of the package and in addition ensure that the crane jib head remains well vertically aligned over the load, it happens fairly frequently that the load is raised at a slant with a cable pulling at a considerable angle with respect to the vertical.

There then occurs ripping of the loads, collisions, danger of the packages catching one another or in the bulwarks of the supply ship and in the limit, there is a risk of twisting the crane jib which is not constructed to withstand considerable lateral traction forces.

To overcome these aforementioned drawbacks, other flexible devices of the damper electrical pulley-block jack or electrical cable type have already been tried but, hooked to the crane hook or installed on the crane itself, they have the major drawback of having much too limited a travel which does not permit the manipulations to be followed as soon as the amplitude of the heaving increases even rather little, although the general environmental conditions may still permit operating with full safety; in addition, this equipment is rather fragile, which is incompatible with the severe conditions under which they are often obliged to operate.

It is therefore an object of the present invention to provide a device for the removal and deposition of loads between two supports in relative heaving movement without a risk of impact against the packages or of catching the latter on one another or on the bulwarks of the ship, and this up to the limit of operational possibilities in a heavy swell.

GENERAL DESCRIPTION OF THE INVENTION

The device according to the invention relates notably to a crane hook from which is suspended a lifting device comprising an attachment cable for the load, the latter and the crane resting on respective supports in relative vertical movement. In this device, after attaching the load to the cable of the lifting device, the latter is tightened to a tension less than the weight of said load. This tension is maintained by automatic taking in or paying out of the cable which compensates for the heaving of the supports at a predetermined time and authorization is given for the braking of said cable and the starting of the lifting of the crane hook at an average speed. According to the invention, the triggering of the braking action of the attachment cable is delayed until after said authorization, the stopping of the winding in of said cable is detected on the equalization of the lifting speeds of the crane hook and of the load and automatic triggering of the braking of this cable is provided in response to the stop signal.

It is also possible to accelerate if necessary the speed of lifting of the crane after said braking. In the case of the depositing of the handled load provision is made for lowering the crane hook until the load rests on the support intended to receive it, the attachment cable of the device being still braked. The depositing of the load results in elimination of the tension in said cable, which automatically results in the release elimination of the brakes. The lowering of the crane hook in the direction of support is pursued, slack being thus given to said cable, the load unhooked and the device raised again.

The device according to the invention comprises a supporting metal structure which is suspended from the lifting crane hook and which supports the assembly of elements constituting it, an attachment cable for the load to be lifted, a compensating winch ensuring constant tension in the cable after its attachment to the load for the lifting of the latter, a control member for the taking in or paying out of the cable, braking means for the winch to ensure the static support of the load after its lifting, memorizing means for a delayed braking order, said memorizing means being adapted to order the braking on the stopping of the winding in, measuring means for the tension of the attachment cable capable of interrupting the braking of the winch in the case of over-tension or disappearance of said tension, an operating and control panel located in the crane cabin and an umbilical cord connecting said panel to the device and serving to transmit back the signaling and the actuating orders.

BRIEF DESCRIPTION OF THE DRAWINGS

The invention will now be described in more detail, with reference to a preferred embodiment given purely by way of non-limiting example and shown in the accompanying drawings.

In the drawings.

DESCRIPTION OF A PREFERRED EMBODIMENT

Figure 1:
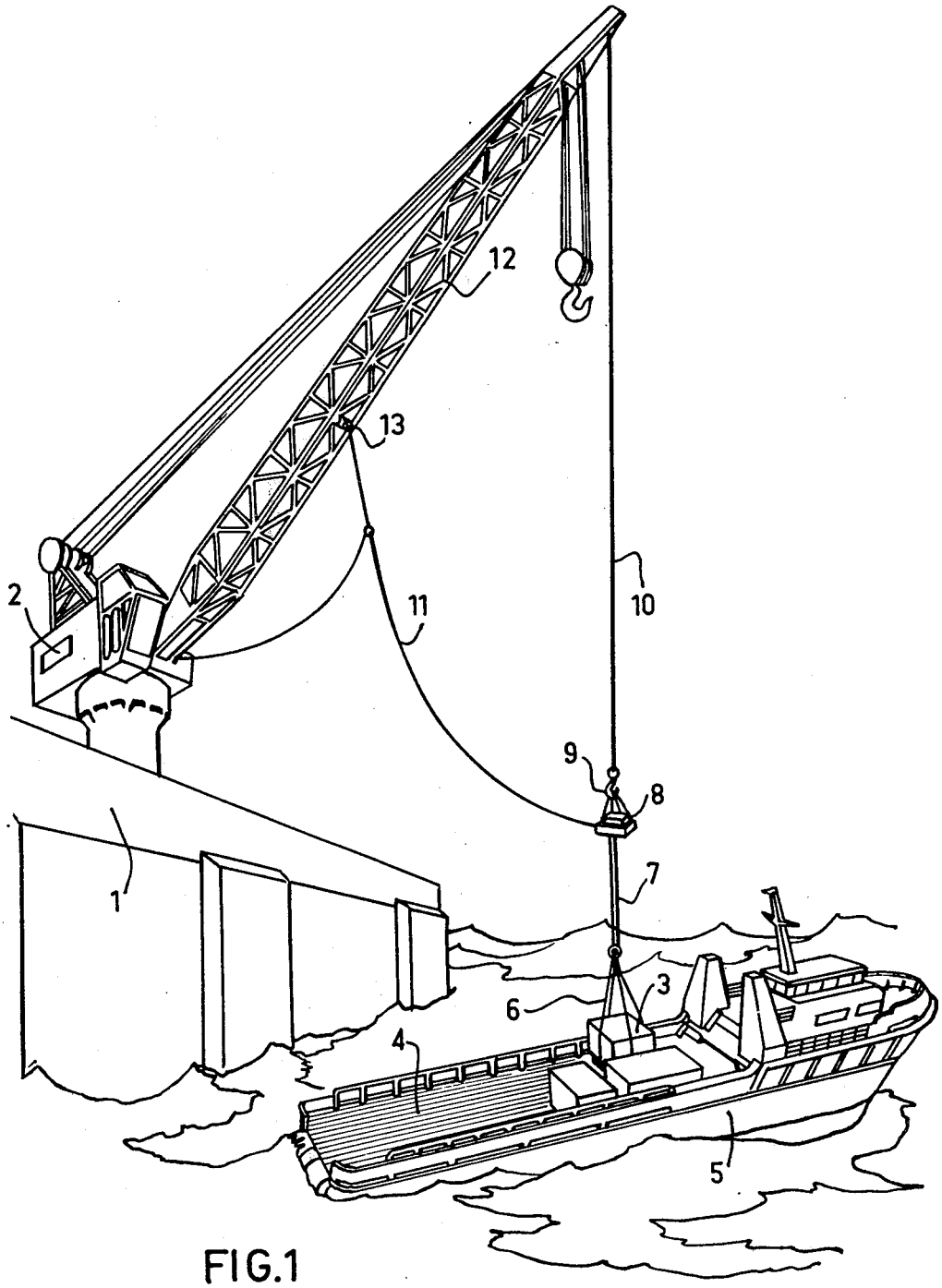
FIG. 1 is a general view showing the application of the method and device according to the invention.

In FIG. 1 is shown a marine platform 1 supporting a crane 2 in the course of lifting a package or load 3 from the deck 4 of a supply ship 5, the package 3 being connected by sling 6 to a vertically extensible and retractable attachment or lift cable 7 of the load supporting frame or device 8 according to the invention, itself hanging from the hook 9 of a vertically movable main hoisting cable 10 of the crane and supplied with electrical power through an umbilical cable 11 serving also for transmitting the actuating and signaling orders, arranged in festoon below the jib 12 of the crane to which it is hung through at least one cable winder 13 and which connects the device to a driving and control panel located in the crane cabin.

Figure 2:
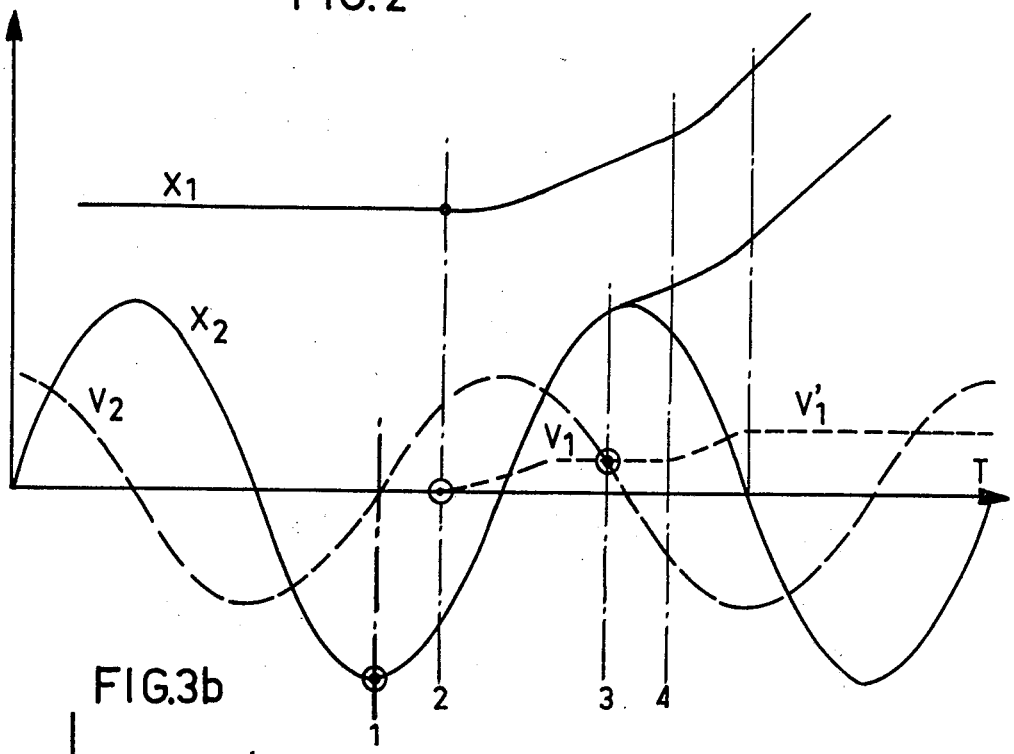
FIG. 2 is a graph illustrating the basic principle of the invention.

The removal of a load according to the invention is illustrated in FIG. 2 and consists, for the essential part, in lifting the load from the deck of the supply ship at the moment when the latter arrives close to its high or extreme upper point during the decreasing speed of the rising motion of the swell, the rate of ascent of the crane hook being then equal to that of the deck of the ship, that is to say when the speed vector of the ascent of the crane is tangential to the curve of the heaving motion. On the graph of FIG. 2, the curve $X_1$ is the locus of the positions of the removal device as a function of time T (as abscissae), the curve $X_2$ is the locus of the positions of the package to be removed, the curve $V_1$ represents the speed of lifting of the crane and the curve $V_2$ that of the heaving motion.

The package is attached to the loading supporting device according to the invention whose cable is unwound or wound as a function of the vertical motion of the package so as to remain always taut (area from 0 to 1). When the ship arrives in the vicinity of its extreme lowest position (position 1), the crane operator sends the delayed gripping authorization to the automatic brake and starts the lifting of the hook 9 of his crane, which only commences to produce its effect on the load supporting device at position 2 due to the fact of the inertia of the assembly. Since the ship then has a more rapid rising movement than that of the load supporting device, the package remains on the deck, the attachment cable 7 being wound in so as to remain taut. As the speed of heaving $V_2$ diminishes during the rising phase of the heaving motion and becomes equal to the speed $V_1$ of the load supporting device (position 3), the attachment cable 7 ceases to be wound in and is locked in fixed position, which has the effect of removing the package naturally from the deck of the ship through the difference of speeds, the operation being carried out gradually without shock. The crane operator can then if necessary pass to a faster speed of hoisting (position 4) to separate the load from the deck more quickly before the reascent of the ship on the crest of the wave.

The starting up of the hoisting of the crane and the authorization for delayed gripping of the automatic brake are preferably ordered at the moment when the ship is in low position, but they may be effected at any moment during the vertical movement of the ship, the preference for the low position limiting only the length of cable unrolled from the device.

Figure 3B:
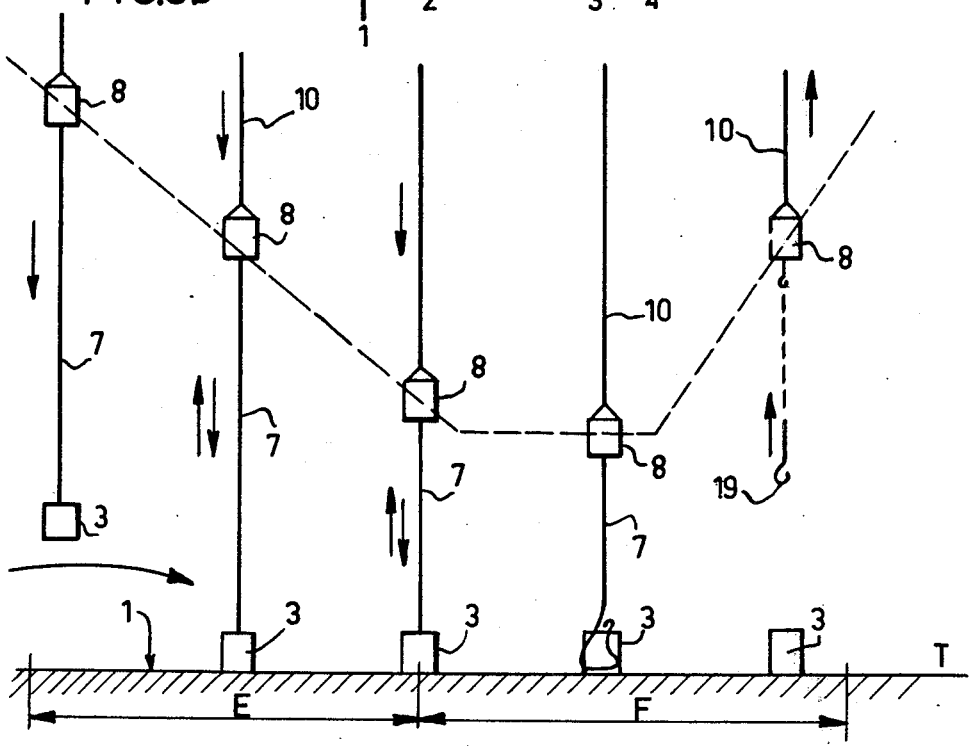
FIGS. 3*a* and 3*b* illustrate respectively the various operational sequences according to the invention for the removal and deposition of the load.
Figure 3A:
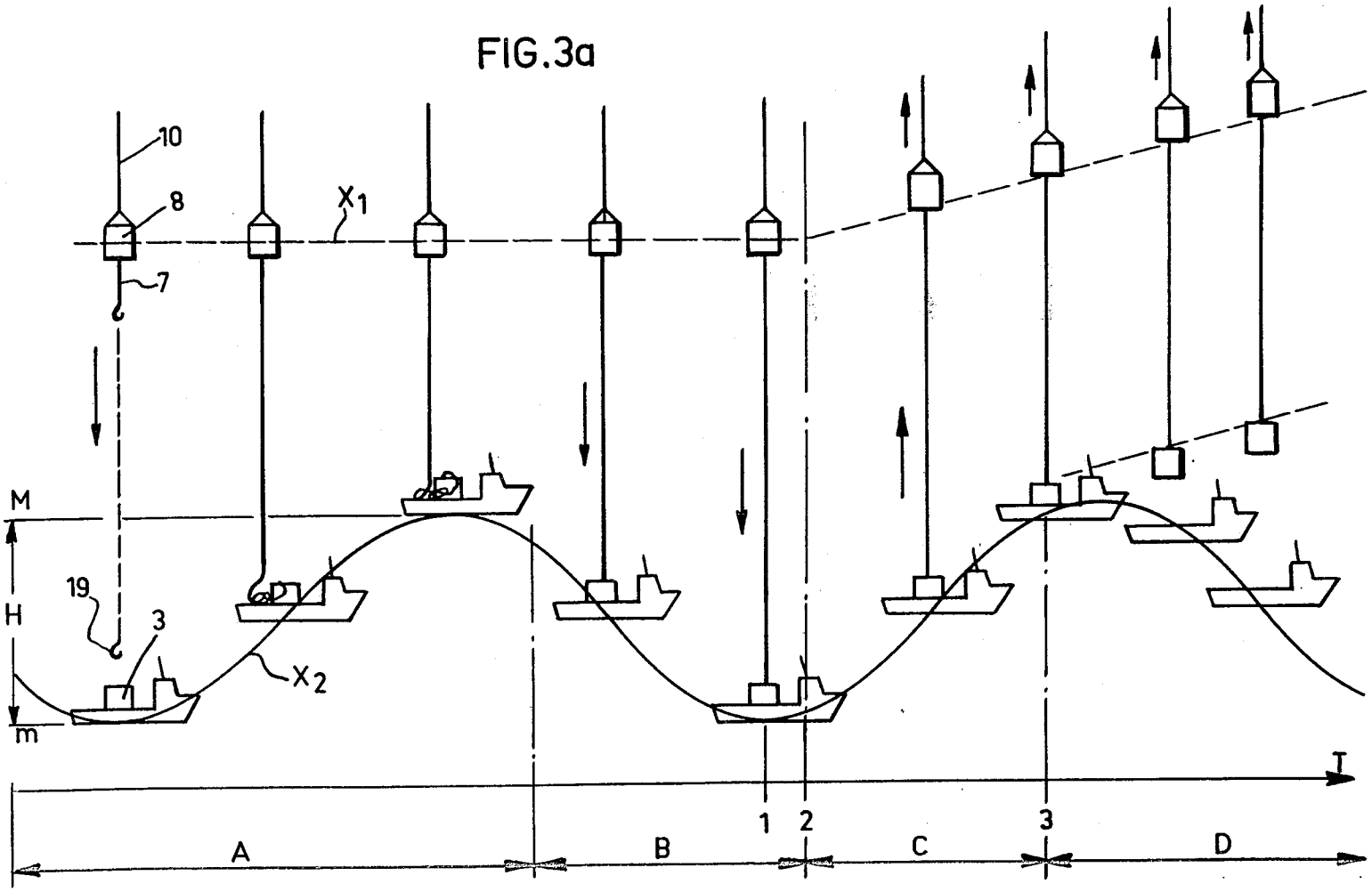

The various sequences of the lifting process whose principle has just been described are illustrated in FIG. 3*a* which shows the respective vertical positions of the device 8 hung from the lifting cable 10 of the crane and from which hangs the lift cable 7 provided with a hook and the package 3 hung by its slings. Here will be seen the curves $X_1$ and $X_2$, the locations of the respective positions in time T of the device 8 and of the package 3, the latter oscillating between a low position m and a high position M, the amplitude H of these oscillations being that of the vertical motion of the ship.

In the first phase A, the lift cable 7 of the device 8 is brought vertically over the package 3 and unwound by a predetermined length at least as great as the amplitude $H_1$ thereby covering the various cases of normal operation, and the crane hook is lowered so that the hook of the device 8 rests permanantly on the deck of the ship during the whole vertical movement of the latter, which permits the attachment without difficulty of the slings of the package to the hook of the cable 7 of the device. In a second phase B, the cable 7 is slightly tightened and wound in or unwound automatically from the device 8, as a function of the rising or falling movement of the package 3 which still rests on the deck of the ship. When the ship arrives in the vicinity of its extreme low position (position 1), the crane operator gives the order authorizing the delayed gripping of the automatic brake and starts the lifting of the crane hook 9 at the average speed of his crane (position 2). Then phase C is started, during which the attachment cable 7 is wound in under a tension less than the weight of the load. The braking only intervenes in a manner so as to lock the cable when the speed of ascent of the package, that is to say in fact the speed of heaving of the ship in its rising movement, has decreased and is equal to that of the rate of upward movement of the device 8 by the crane hook 9. In other words, at the moment when the package 3 and the device 8 moves upwardly at the same speed, the winding in of the cable 7 ceases naturally and the brake is automatically applied (position 3). From this moment, the unwound length of the cable 7 remains constant and the lifting cable 10 of the crane continues its ascent, whereby the package is gradually lifted without shock from the deck of the ship which redescends after having traversed its maximum high point (phase D). The package is sufficiently separated from the deck of the ship to avoid any impact on the following return of the ship into high position, this movement of separation being capable of further acceleration by intervention of the crane operator if he can pass into a faster speed of lifting after the position 4 in phase D.

To deposit the package 3 on the platform 1 (FIG. 3*b*), the crane operator lowers it with the crane hook 9 onto the deck of the latter, the device 8 remaining locked by the brake. When the package is deposited on the platform 1, the tension in the cable 7 of the device is eliminated. The stress detector measuring the tension in the cable 7 senses this drop in stress and triggers the automatic opening of the brake and the motion compensation resumes automatically (phase E). The crane operator then continues to lower his crane hook 9 and stops the motion compensation, which has the effect of gripping the brake, of giving slack to the cable 7 of the device and of permitting the cable 7 from the unhooking of the package (phase F). The crane operator can also order the unwinding of said cable 7, which has the effect of stopping the compensation and giving the necessary slack for the unhooking of the package.

Figure 4:
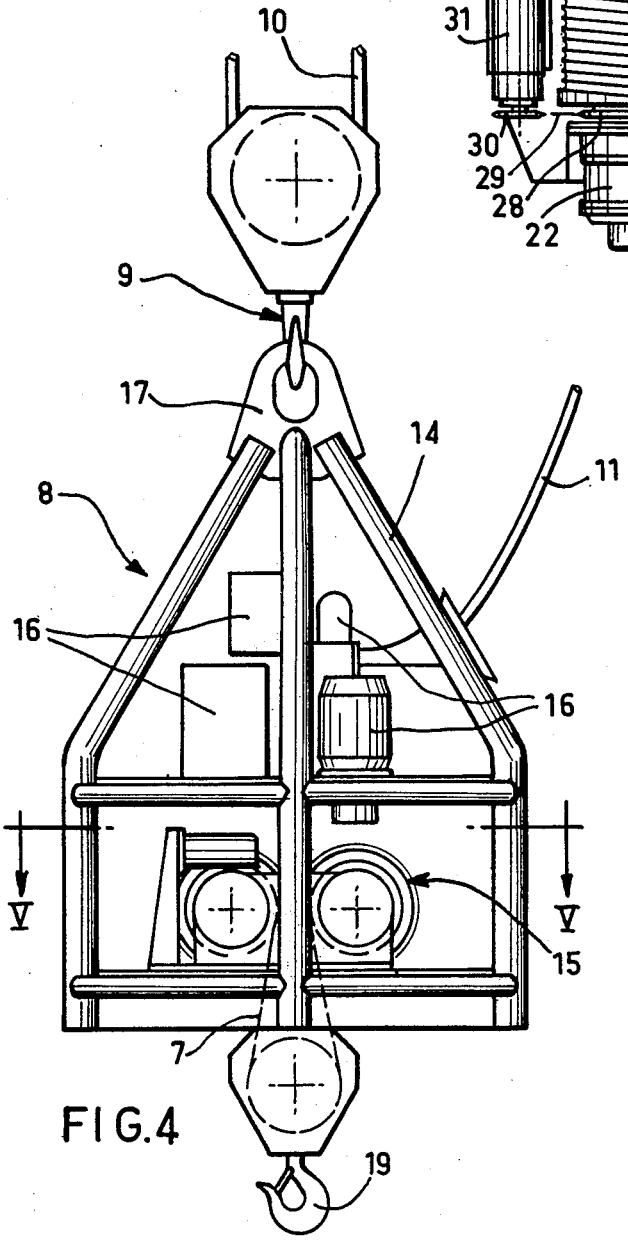
FIG. 4 shows an embodiment of the removal and depositing device according to the invention.

In FIG. 4 is shown a load supporting device according to the invention, this device being attached to the hook 9 of the lifting cable 10 of the crane and supplied with electrical power through the unbilical cable 11 connecting it to the crane cabin, said umbilical cable serving also for transmitting the actuating orders given by the crane operator and in reverse direction the signals emitted by the detectors belonging to the device 8. The latter is essentially composed of a steel structure 14 supporting a compensating winch 15, a hydraulic actuating and control assembly 16 as well as, incorporated in the top part of said structure, a weighing means 17 for detecting forces at two thresholds and a signaling assembly, the cable 7 unwound below the structure 14 by the compensating winch including, for example, two strands supporting a pulley hook 19.

Figure 5:
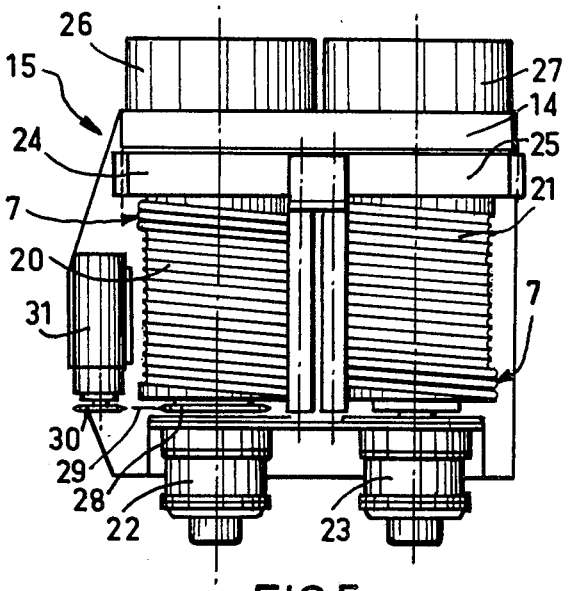
FIG. 5 is an enlarged view from above of the motion compensating system of the embodiment of FIG. 4.

As seen from above in FIG. 5, the compensating winch 15 includes two drums 20 and 21 with parallel axes designed to receive opposite ends of attachment cable 7. The two drums 20 and 21 are each driven by a hydraulic motor respectively 22 and 23 and rotary synchronization is obtained by means of identical gearing 24 and 25 in engagement, keyed respectively to the shafts of said drums. In this structure 14 are mounted multi-disc brakes 26, 27 whose discs are keyed at the end of the shafts of the drums 20 and 21. The drum 20 includes, keyed to its shaft, a chain gear 28 driving through a chain 29 the pinion 30 of a position detector device 31, comprising an electrical control system for the winding and unwinding of the cable 7 on the drums of the compensating winch 15, for example from pulse counters.

Figure 6:
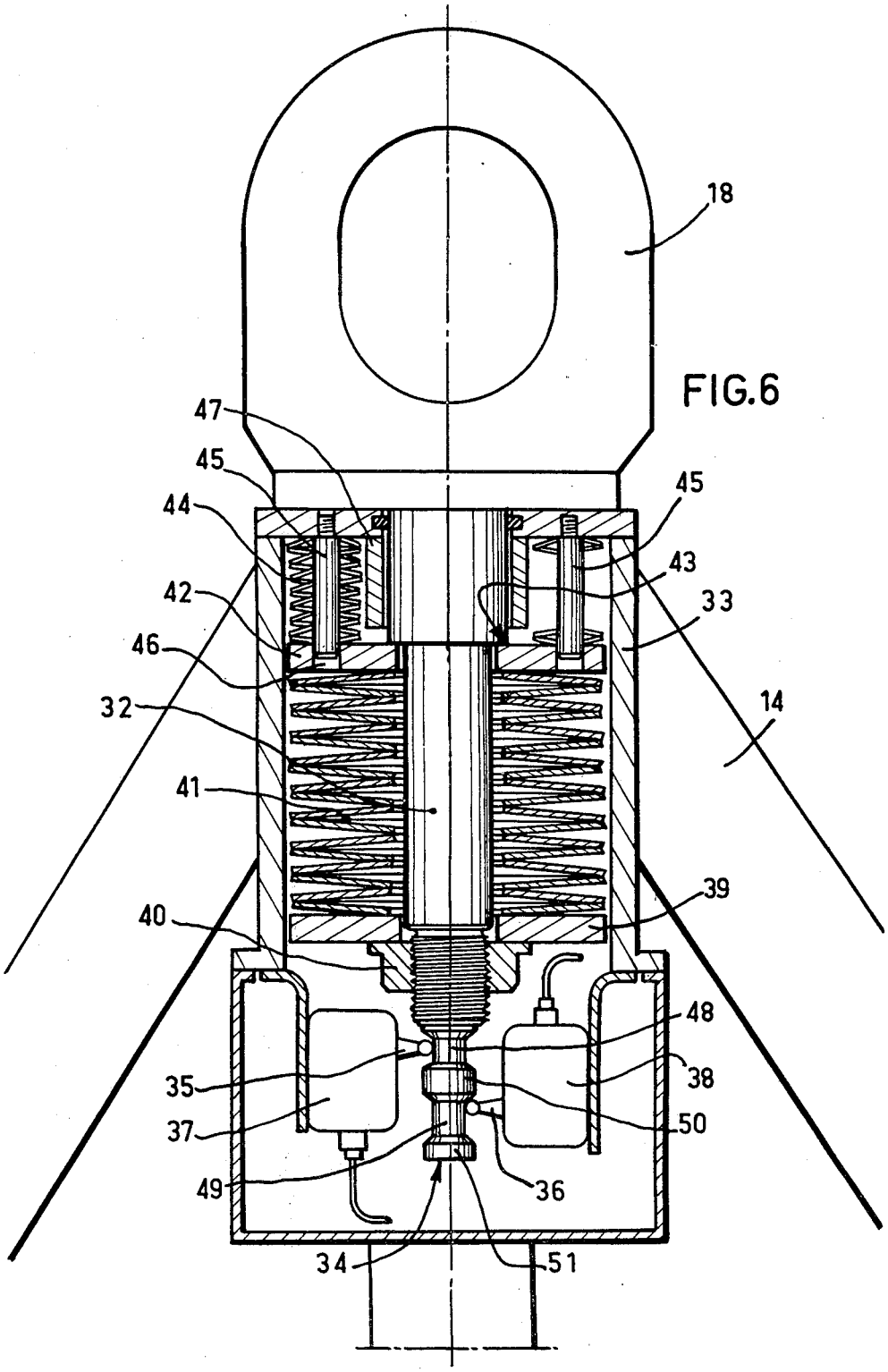
FIG. 6 is a longitudinal section of the weighing means arranged on the upper part of the removal and depositing device.

FIG. 6 shows the detail of the weighing means 17 with two detector thresholds integrated in the upper part of the structure 14. This weighing means is composed of an attachment ring 18 extended downwards by a shouldered cylindrical axle 32 serving as guide axle for a box 33 fast to the structure 14, said axle 32 including at its lower end a cam 34 on which bear two feelers 35 and 36 belonging to two electrical end-of-travel detectors 37 and 38 fixed inside the box 33.

The axle 32 supports the structure 14 of the lifting device through two elastic compressible systems stacked on a first plate-support 39 provided with a central bore and fixed to said axle by a nut 40 screwed on a threaded portion of the latter.

The stack comprises a first series of cup washers of large diameter surmounted by a second support plate 42 pierced at its center, the assembly being threaded onto the axle 32, of which a shoulder 43 limits axial upward movement; the cup washers can be subjected to prestressing between the two plates 39 and 42 by tightening the nut 40. On the plate 39, between the latter and the bottom of the casing 33, are interposed several stacks of cup washers of small diameter 44 threaded onto guide pins 45 tightly gripped in the bottom of said casing and slidable in corresponding orifices 46 pierced in the plate 42, the elastic resistance to compression of the assembly of these stacks of washers 44 being less than that of the sub-adjacent stack of washers 41 of large diameter. A brush 47 is lastly provided fast to the bottom of the casing 33 and surrounds the shouldered portion of the axle so that, when traction is exerted downwards on the structure of the device, the bottom of the casing 33 starts by compressing the sets of washers 44 of smallest diameter, until the bush 47 comes into abutment against the support plate 42 and assures thereby the compression of the stack of washers 41 of large diameter.

The cam 34 includes two waists 48 and 49 separated by an upset portion 50, the ends of the feelers 35 and 36 of the force detectors 37 and 38 being located in the waisted portions of the cam when the weighing means only supports the weight of the device, the feeler 35 of the detector 37 coming into abutment against the upper shoulder of the waist 48, which closes the electrical contact of the first detector 37 at the end of its travel and indicates that the tension in the cable is nil and releases the brakes. In the same way, when the washers 41 are too compressed, the feeler 36 of the second stress detector 38 comes into abutment against the end shoulder 51 of the axle, thus closing the end-of-travel contact of the second detector, which indicates that it is overloaded and also actuates the opening of the brakes. Due to this weighing means 17, it is hence possible to detect two end stress thresholds capable of being supported by the device 8 according to the invention. Between these two end limits, when a normal load is suspended, the brakes are locked without possibility of opening, which constitutes a safety feature. Of course, the stacks of cup washers may be replaced by any other known elastically compressible members, such as, for example, helicoidal springs.

Figure 7:
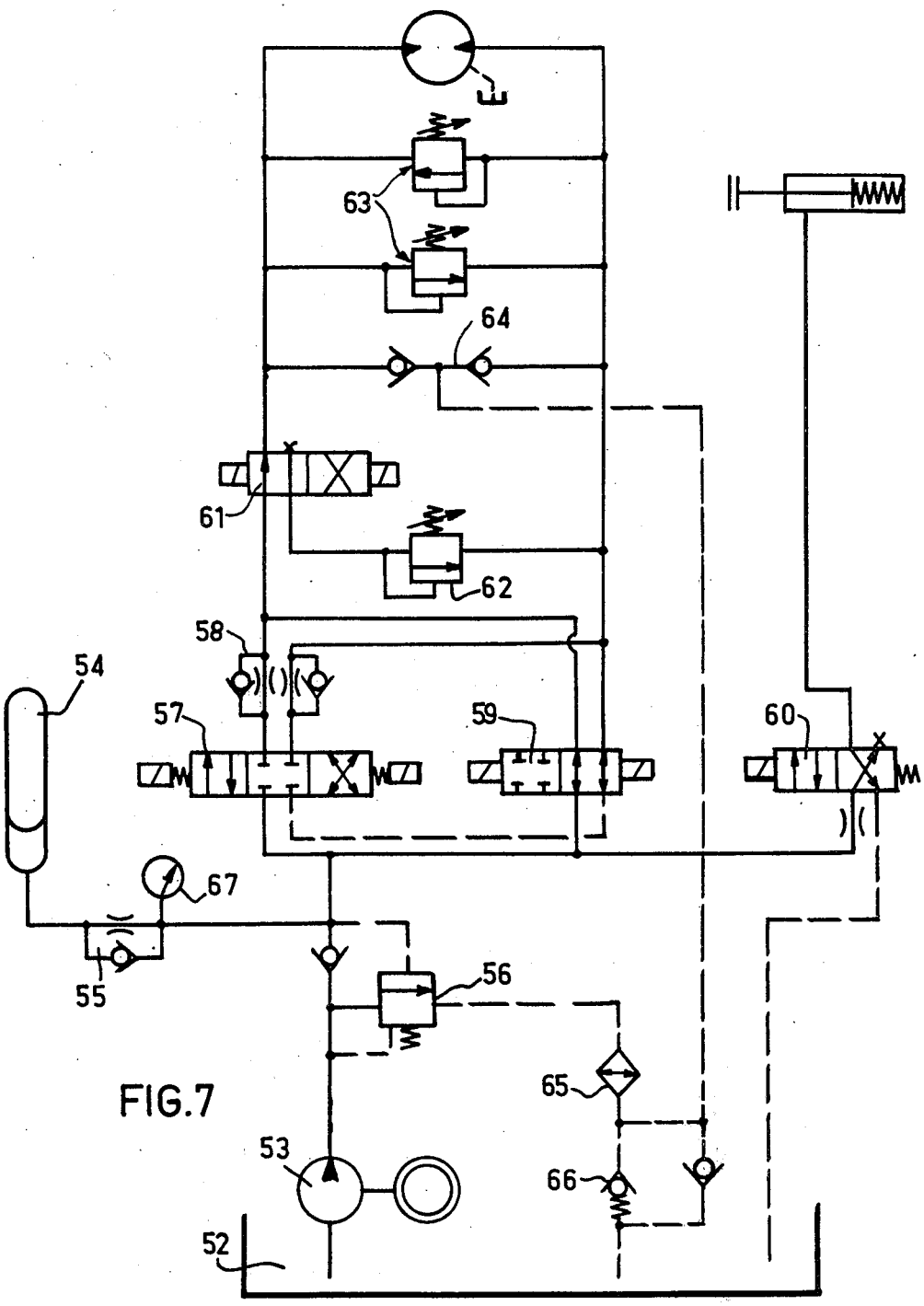
FIG. 7 is a schematic diagram of the hydraulic circuit of the device according to the invention.

Finally, FIG. 7 shows the whole of the hydro-pneumatic control equipment of the lifting device 8 which is composed essentially of a reservoir 52, a motor pump unit 53, a hydro-pneumatic accumulator 54 and its braking means 55, a sequencing valve 56 enabling the direct application of the pump 53 to the reservoir 52 when the accumulator circuit 54 is at the desired pressure, an electro-distributor 57 and its two-way braking means 58 enabling the control of the winding and unwinding of the cable 7 for length adjustment in the preparatory phase for lifting, an electro-distributor for applying compensation 59, an electro-distributor 60 for locking the winch by means of the brakes 26 and 27, an electro-distributor 61 enabling the reduction in pressure of the supply circuit by means of a pressure limiting valve 62 during the compensation phase when the distance between the crane hook and the ship increases in order to maintain constant tension in the cable of the device, the winch being at this moment driven to unwind through the cable which connects it to the package, safety valves 63 and pressure replenishing valves for the circuit 64. The cooling device 65 for the circuit may be by natural or forced ventilation, as necessary. A calibrated valve 66 installed on the return line enables better replenishment of the circuits. The pressure switch 67 indicates a lack of hydraulic pressure in the circuit, prohibiting a handling operation.

When it is desired to lift a load 3 from the deck 4 of the ship 5, the device 8 is unwound by a length of cable 7 greater than the value of the amplitude of the vertical movement to avoid placing the cable under tension during the attachment of the load 3.

After the attachment, the motors 22 and 23 of the compensating winch 15 are energized, the brakes 26, 27 being released, which has the effect of subjecting the cable 7 to slight tension. The device 8 hence enables the variations in distance between the end of the crane and the deck 4 of the ship to be compensated, the winch 15 winding and unwinding cable 7 in order to keep it tightened under low tension.

When the ship 5 passes close to the low position of its vertical movement, the crane operator gives the order permitting locking of the braking system, without however actually braking, and actuates the lifting at low speed of the cable 10 of the crane, which has the effect of raising the device 8 without raising the load 3, the compensation continuing to keep the attachment cable 7 under constant tension, with the brake unapplied. A light signal indicates this order on the device and on the control panel located in the crane cabin. As the ship approaches the upper extremity of its vertically upward movement, the ascending speed of heaving of the ship 5 decreases and becomes equal to the speed of ascent of the cable 10 of the crane 2, whereupon the compensation winch 15 stops winding naturally, which automatically causes the carrying out of the memorized order to lock the brakes 26–27.

This case is only possible at the end of the rise of the ship, as shown in FIG. 2. At this moment, a new signal is emitted, indicating to the crane operator that the brakes are gripped, that the package will be lifted and that it is possible if necessary to pass to a higher hoisting speed to separate the load from the deck of the ship more rapidly. The electrical detection device 31 only permits actual braking when the compensating winch 15 winds the cable 7 at a diminishing speed, that is to say in the upper half-amplitude in ascending movement.

To place the package 3 on the platform 1 (FIG. 3*b*), the crane operator lowers it onto the deck of the latter, which has the effect of removing the tension in the cable 7, and the stress detector 17 detects this dropping tension (low level), initiates the opening of the brake and places the device 8 automatically "under tension" (phase E).

The crane operator continues to lower the crane hook and orders the stopping of compensation, which has the effect of causing the brake to grip, to produce slack in the cable and to permit the unhooking (phase F). It is also possible to actuate the unwinding of the cable, which has the effect of stopping compensation and producing the necessary slack for the unhooking of the package 3.

The same manoeuvre can be carried out to deposit a package on the deck of a supply ship in the case of unloading a platform. In this case it is necessary to select an opportune moment, that is to say close to the crest of the movement of the ship, to deposit the package with minimum shock.

In the case of handling accidents, for example if, in the course of lifting the load, the latter catches another package or a part of the supply ship, an excess of tension is detected by the force detector 17 which automatically orders the opening of the brakes. This constitutes an automatic protection against overloads, the device being then automatically placed again under "tension", whilst the signal informs the crane operator.

If the load is still positioned on the deck, the crane operator stops the ascent of the crane and if necessary relowers the crane hook. The deck personnel of the ship can intervene to disengage the obstruction. If unsuccessful, the unwinding can be actuated at the same time as the lowering of the crane hook so as to be able to detach the load.

On the other hand, if the load is already lifted, it will fall onto the deck and will automatically recover a position of automatic tensioning (tightening slings) which then comes back to the preceding case.

To limit the lowering speed of the load, it is possible to arrange to cause only the opening of a single brake, the brake remaining in service ensuring by slippage braking of the fall.

Where an excursion outside of the normal area of development in the plane of the supply ship or the accidental engagement of the sling is concerned, the drums of the winch 15 continue to unwind, reaching the "end-of-travel" positions, and a signal warns the crane operator. If necessary, the cable can be unwound beyond and even be held by the end. It is possibly recoverable, but the package has not left the deck of the ship, has not been subjected to inadvertent shifting and the crane has not undergone harmful horizontal pulling.

Where too heavy a load is concerned, still resting on the deck, the force detector triggers the signal warning the crane operator, causes the automatic opening of the brake, and the device 8 comes back automatically to the "tensioning" position, whilst the crane operator stops the ascent of the cable 10 of the crane.

Finally, the device according to the invention includes safety means, in particular in the case of a lack of oil in the reservoir which results in the emission of a signal, the compensation being still able to operate for some time to terminate the manoeuvres under way, or again in the case of a lack of oil pressure or a lack of electrical power, a signal is then emitted and the compensation is stopped, whilst the brakes are automatically gripped; the over-tension detection system remains in operation and enables the brake to be "jettisoned" in case of need, by means of a small safety accumulator provided for this purpose.

Finally, the device for removing loads according to the invention has the following advantages.

it is hung from the crane hook and, consequently, completely independent of the mechanism of the latter which hence has no need to be modified, the device being adaptable almost immediately to any crane. In addition, this device is autonomous and supplied and controlled directly by one electrical cable.

it ensures the compensation of the effect of swell by the tensioning of the slings before the removal of the load, which enables notably elimination of the dead time necessary to tighten the slings just before the lifting of the package and to avoid accidently engaging the slings when they are too slack in coils, on another package or on an accessory of the supply ship;

it includes a winch if necessary with a double drum and possesses for this reason, a long travel well above that of all jack systems and enables, consequently, considerable movements of the ship, both vertically and in the same plane, without risk of rupture of the sling nor of the introduction of abnormal forces into the crane jib; in addition, the twinning of two lifting drums of the attachment cable 7 enables the latter to be maintained constantly in the vertical axis of the device, hence an extension of the lifting cable 10 of the crane, there is automatic operation, but it allows the crane operator, nonetheless the possibility of deciding before the gripping of the brakes not to raise the load by action on the cancellation knob for permitting braking on the control panel, it constitutes in itself a force limiter, whether in the case of inadvertent attachment to another package or a headledge, for example, or in the case of too heavy a load.

Of course, the scope of the invention is not limited to the single embodiment described above by way of non-limiting example, but it covers also any modification which will differ only in details.

Thus, for example, the device according to the invention may be used for other applications than that previously described, that is to say the supply of marine platforms, and in particular for rescue at sea or on the mountain by helicopter, or again for the transportation of loads also by helicopter in the high mountains (for example for bringing up framework elements for a steel pylon) or again to an elevated point (on the roof of a tower, the top of a steeple, etc.).

We claim:

1. Apparatus for transferring a load between relatively vertically moving supports on one of which is a crane having a load lifting cable, said apparatus comprising a frame suspended from said load lifting cable; a vertically extensible and retractable second cable carried by said frame and supporting a hook for fitting to said load; operating means supported wholly by said frame and including rotary winch means coupled to said second cable and drive means for rotating said winch means for vertically extending and retracting the latter to lower and raise said hook an amount at least equal to the amplitude of relative vertical movement of said supports; and means for disabling said operating means and maintaining said hook in a selected position of vertical adjustment relative to said frame.

2. Apparatus according to claim 1 wherein said disabling means comprises a brake operable to prevent rotation of said winch means.

3. Apparatus according to claim 1 including means for sensing the presence of tension in said second cable.

4. Apparatus according to claim 1 including means for sensing the absence of tension in said second cable.

5. Apparatus according to claim 1 wherein said drive means includes motor means for rotating said winch means in a selected one of two different directions.

6. Apparatus according to claim 5 wherein said disabling means comprises brake means operable selectively to permit and prevent rotation of said winch means.

7. Apparatus according to claim 1 wherein said operating means includes a second rotary winch means said second cable having its opposite ends wound around the respective winch means, and said hook being supported by said second cable between the ends of the latter.

8. Apparatus according to claim 7 wherein said drive means includes motor means for rotating at least one of said winch means in either of two different directions.

9. Apparatus according to claim 8 wherein said disabling means comprises brake means operable selectively to permit and prevent rotation of said one of said winch means.

10. Apparatus according to claim 1 wherein said winch means is reversible; said drive means includes reversible motor means for driving said winch means in a selected one of two different directions; and weight responsive means in circuit with said motor means for controlling the operation of the latter.

11. Apparatus according to claim 10 wherein said weight responsive means includes two stress detectors operable respectively to detect the presence and absence of tension in said second cable.

12. Apparatus according to claim 1 wherein said means for disabling said operating means comprise first stress detector means operable to detect the presence of tension in said second cable and to command maintaining said hook in said position when a load is suspended from said hook; and second stress detector means operable to detect the presence of an excess of tension in said second cable and inhibit the disabling of said operating means if such excess is detected.

* * * * *